US005262234A

United States Patent [19]

Minor et al.

[11] Patent Number: 5,262,234

[45] Date of Patent: Nov. 16, 1993

[54] POLYETRAFLUOROETHYLENE FIBER CONTAINING CONDUCTIVE FILLER

[75] Inventors: Raymond B. Minor, Elkton, Md.; Gordon L. McGregor, Nottingham, Pa.; William P. Mortimer, Jr., Conowingo, Md.

[73] Assignee: W. L. Gore & Associates, Inc., Newark, Del.

[21] Appl. No.: 915,484

[22] Filed: Jul. 16, 1992

Related U.S. Application Data

[63] Continuation-in-part of Ser. No. 777,984, Oct. 17, 1991, abandoned.

[51] Int. Cl.[5] ..... D06G 3/00

[52] U.S. Cl. ..... 428/372; 428/364; 428/375; 428/421; 264/127; 264/147

[58] Field of Search ..... 428/364, 375, 421, 372; 264/147, 127

[56] References Cited

U.S. PATENT DOCUMENTS

| | | | |
|---|---|---|---|
| 3,953,566 | 4/1986 | Gore | 264/191 |
| 4,031,283 | 6/1977 | Fagan | 264/147 |
| 4,064,214 | 12/1977 | Gore | 428/364 |
| 4,478,665 | 10/1984 | Hubis | 264/127 |
| 4,680,220 | 7/1987 | Johnson | 428/240 |
| 5,061,561 | 10/1991 | Katayama | 428/364 |

FOREIGN PATENT DOCUMENTS

| | | |
|---|---|---|
| 344689 | 12/1989 | . |
| 1384016 | 2/1975 | Fed. Rep. of Germany . |

*Primary Examiner*—Patrick J. Ryan
*Assistant Examiner*—N. Edwards
*Attorney, Agent, or Firm*—Samuels, Gary A.

[57] ABSTRACT

A fiber of expanded porous polytetrafluoroethylene in which an amount of a conductive particulate filler is incorporated imparting a measure of conductivity to the fiber is disclosed. The fiber may be twisted along its length. The fiber may be a continuous monofilament fiber, a tow, a staple, or a flock.

13 Claims, No Drawings

POLYETRAFLUOROETHYLENE FIBER CONTAINING CONDUCTIVE FILLER

CROSS-REFERENCE TO RELATED APPLICATION

This application is a continuation-in-part of application Ser. No. 07/777984 filed Oct. 17, 1991 is now abandoned.

FIELD OF INVENTION

This invention relates to expanded porous polytetrafluoroethylene fibers filled with conductive particulate material.

BACKGROUND OF THE INVENTION

In the past, fibers have been used for their electrical properties, and fibers which possess a degree of electrical conductivity have been incorporated into articles to increase the conductivity of the article and to provide a measure of electrostatic discharge (ESD) protection to the article. Types of fibers utilized for their electrical conductivity include naturally occurring fibers, such as wool, which provide a measure of electrical conductivity due to the fact that a certain amount of moisture is normally found on the fiber's outside surface. Moisture associated with the fiber's outside surface can provide a conductive pathway, thereby permitting static electric charges present on the outside surface of the fiber to dissipate.

Man-made fibers based upon commonly produced polymeric materials used in the production of fibers such as polyamides or polyesters have been used to produce fibers which possess a degree of electrical conductivity. These man-made fibers may be treated on their outside surfaces with a conductive agent to increase the finishes which are applied to the outside surface of the fiber. Durability of antistatic finishes are usually less than the fiber on which the antistatic finishes are placed. Fibers which rely on such finishes for electrical conductivity can gradually lose their antistatic finishes while in use or through a cleansing process and become less electrically conductive overtime.

Conductive agents may also be in the form of a coating of a metal or carbon black placed on the outside surface of a fiber. The durability of the coating of metal or carbon black is dependent on the ability of these materials to bond and remain bonded to the outside surface of the fiber. If the coating is less flexible than the fiber on which it is placed, the coating may crack producing discontinuities in a conductive pathway provided by the coating.

Conductive agents have been incorporated into man-made fibers to provide a permanently conductive fiber. Conductive agents that have been incorporated into man-made fibers include antistatic finishes, carbon blacks and powdered metals. The conductive agents may be distributed throughout the man-made fiber or may be contained within a conductive core or strip. The electrical properties of these fibers usually remain for the life of the fiber. However, the polymeric materials used to produce these fibers, such as polyamides or polyesters have utility over a relatively narrow range of temperatures and chemical and environmental conditions.

Polytetrafluoroethylene (PTFE) exhibits utility over a relatively wide range of temperatures and chemical and environmental conditions. PTFE is usable over a temperature range from as high as 260° C. to as low as near −2730° C. PTFE is also highly resistant to attack from many harsh chemical reagents. However, PTFE does not possess exceptional strength. A form of PTFE, expanded porous polytetrafluoroethylene (EPTFE) as produced by the method taught in U.S. Pat. No. 3,953,566 to Gore, exhibits higher strength than PTFE. EPTFE is an excellent dielectric material and has been used as an insulative layer on wire and cable applications.

ePTFE in film form has been filled with various fillers as taught in U.S. Pat. Nos. 4,187,390 to Gore and 4,985,296 to Mortimer, Jr. Conductive fillers are taught as well in Gore and Mortimer, Jr., however, the filled EPTFE articles taught are in film form and not in fiber form.

The present invention is directed to EPTFE fibers which are filled with an amount of conductive filler thereby imparting a degree of electrical conductivity to the fiber.

BRIEF DESCRIPTION OF THE INVENTION

The product of this invention is a fiber comprising an expanded porous polytetrafluoroethylene matrix in which a conductive particulate filler is distributed wherein the fiber has a bulk tensile strength of 65,000 KPa or greater and a volume resistivity of $1\times10^9$ ohm cm or less.

DETAILED DESCRIPTION OF THE INVENTION

A fiber of the present invention is produced from an EPTFE matrix in film form in which an amount of a conductive particulate is contained. The EPTFE matrix in film form is produced in the following manner:

A fine powder PTFE resin is combined with a conductive particulate through one of two methods. The conductive particulate having utility in the present invention may be selected from a group consisting of metals, metal oxides or carbon blacks. By "particulate" is meant individual particles of any aspect ratio and thus includes flock, flakes and powders.

In one method, an amount of fine powder PTFE resin is mixed with an amount of conductive particulate filler and a sufficient quantity of a mineral spirit, preferably an odorless mineral spirit, in a blender to obtain an intimate mixture of the components and form a compound.

It is preferable to combined fine powder PTFE resin with the mineral spirit prior to the addition of the conductive particulate filler to the blender in order to obtain a consistent mixture of the fine powder PTFE resin and the conductive particulate filler.

In another method, an aqueous dispersion PTFE resin is obtained. Into the aqueous dispersion, a conductive particulate filler is added. The mixture is co-coagulated by rapid shearing of the aqueous dispersion, or through destabilization of the aqueous dispersion with salt, acid, polyethylene imine or the like. A coagulum of fine powder PTFE resin and conductive particulate is subsequently formed and dried into cakes. When dry, the cakes are carefully crumbled and lubricated with a mineral spirit and blended forming a compound.

The compound produced by either of the previously described methods is compressed into a billet and subsequently extruded through a die by a ram-type extruder forming a coherent extrudate. The mineral spirit functions as an extrusion lubricant for the compound.

The coherent extrudate is compressed between a pair of calender rollers to reduce its thickness. Subsequently, the mineral spirit is removed from the calendered coherent extrudate by passing the coherent extrudate over a series of heated rollers. The heated rollers are heated to a temperature at or above the boiling point of the mineral spirit present in the coherent extrudate thereby volatilizing the mineral spirit leaving a dry coherent calendered extrudate.

The dry coherent calendered extrudate is stretched using the general method of expanding PTFE taught in U.S. Pat. No. 3,543,566 to Gore incorporated herein by reference. The dry coherent calendered extrudate is initially rapidly stretched uniaxially in a longitudinal direction 1.2× to 5000×, preferably 2× to 100× its starting length, at a stretch rate over 10% per second at a temperature of between 35° C. and 327° C. An expanded porous polytetrafluoroethylene (EPTFE) matrix in continuous film form in which is distributed a conductive particulate filler is produced.

The EPTFE matrix in continuous film form may be slit to a desired width by a means for slitting films to form a continuous slit film fiber having a substantially rectangular profile. The continuous slit film fiber is subsequently stretched uniaxially in a longitudinal direction up to fifty (50) times its length. The general method of stretching polytetrafluoroethylene is taught in U.S. Pat. No. 3,543,566 to Gore, previously referenced herein. The second stretching step increases the strength of the resultant fiber producing an expanded continuous slit film fiber. The increase in strength of the expanded continuous slit film fiber is a result of increased orientation of the EPTFE matrix. For any specific conductive particulate filler, the amount of stretching to which the continuous slit film fiber may be subjected is dependent on the percentage of particulate filler present in the fiber. The greater the percentage of particulate filler, the less the continuous slit film fiber may be stretched.

The expanded continuous slit film fiber may subsequently be subjected to a temperature in excess of 342° C. in order to perform an amorphous locking step. This basic procedure is taught in U.S. Pat. No. 3,543,566 to Gore, specifically—at column 3, lines 49-65.If fully restrained longitudinally, the amorphous locking step further increases the strength and density of the expanded continuous slit film fiber.

Alternatively, prior to slitting, the EPTFE matrix in continuous film form may be compressed and densified by a means for compressing, such as a pair of adjacent nip rollers, to reduce the thickness of the EPTFE matrix in continuous film form, as taught in U.S. Pat. No. 4,985,296 to Mortimer, Jr. incorporated herein by reference. Compression and densification increases contact between individual conductive particulate filler particles thereby increasing conductivity of the EPTFE matrix in continuous film form producing a thin EPTFE matrix in continuous film form. To increase the strength of the thin EPTFE matrix in continuous film form, multiple layers of the coherent extrudate are stacked longitudinally and calendered upon one another forming a layered article. The layered article is subsequently dried, expanded and densified to produce a thin EPTFE matrix of greater strength when compared to an analogous thin EPTFE matrix produced from a single layer of EPTFE matrix.

The thin EPTFE matrix may be subjected to the amorphous locking step previously described. The thin EPTFE matrix in continuous film form may be slit to a desired width by a means for slitting films to form a thin continuous fiber having a substantially rectangular profile.

Fibers of the present invention exhibit relatively high bulk tensile strengths with relatively low volume resistivities. Conductive particulate filler distributed in the EPTFE matrix, while responsible for the fiber's volume resistivity, does not contribute to the fiber's strength. Rather, strength of the fiber is as a result of the amount of PTFE present and the strength of that PTFE. However, the formation of an EPTFE matrix, while increasing the strength of the matrix, also reduces its density and, therefore, increases its volume resistivity.

Expansion of the EPTFE matrix for increased bulk tensile strength and subsequent densification of the EPTFE matrix for decreased volume resistivity permits one to tailor the properties of the inventive fiber.

It is possible to increase the conductivity of the fiber by increasing the density of the fiber. The density of the fiber may be increased through compression. Compression of the fiber may be accomplished by passing the fiber through a means for compressing such as, for example, a pair of nipped rollers. Preferably, compression of the fiber may be accomplished through a twisting step, where the fiber is twisted about its central longitudinal axis by a means for twisting forming a twisted fiber. The resultant twisted fiber also exhibits greater maintenance of its volume resistivity upon exposure to tensile forces when compared to an analogous compressed untwisted fiber. The resultant twisted fiber is more dense than an analogous untwisted fiber and appears rounder than an untwisted fiber. The twisted fiber may have 1 to 18 twists per cm preferably 4 to 11 twists per cm.

The density of the fiber may also be increased by subjecting the fiber to the previously described amorphous locking step which causes a degree of shrinkage in the fiber. Densification of the fiber through the amorphous locking step is preferable when the profile of the continuous fiber is to be maintained rather than altered through a compression step.

Fibers of this invention may have a range of volume resistivities. A fiber of the present invention with a volume resistivity of $10^9$ ohms cm or less has utility in providing articles of manufacture with ESD capabilities. A fiber of the invention with a volume resistivity of $10^2$ ohms cm or less has utility in providing articles of manufacture with a measure of conductivity thereby providing electromagnetic interference (EMI) shielding to said articles. The lower value of volume resistivity is not critical and is limited by the conductive particulate used.

Fibers having a bulk tensile strength of 65,000 KPa or greater with a volume resistivity of $1\times10^3$ ohm cm or less, a bulk tensile strength of 65,000 KPa or greater with a volume resistivity of 10 ohm cm or less; and a bulk tensile strength of 200,000 KPa or greater and a volume resistivity of $1\times10^3$ ohm cm or less can be produced using the present invention. The upper value of bulk tensile strength is not critical and is limited by the strength of the PTFE used.

The term "fiber" is defined herein as to include any slender filament and thus includes continuous monofilament, tow, staple and flock.

A continuous monofilament fiber of the present invention may be subsequently formed into a tow comprised of an EPTFE matrix containing a conductive particulate filler. The tow is formed by hackling the continuous monofilament fiber forming a fibrous tow web. This fibrous tow web is subsequently chopped into short lengths thereby producing a staple comprised of a matrix of EPTFE in which a conductive particulate filler is distributed. A chopping into shorter lengths produces a flock.

Fibers of the present invention may subsequently be made in the form of a woven, non-woven or knitted fabric. The fabric may be made solely from fibers of the present invention or may be made from a combination of fibers of the present invention combined with at least one additional fiber. The additional fiber may be a synthetic fiber selected from the group consisting of polyester, polyamide, aramide, graphite, ceramic and metal. Alternatively, the additional fiber may be a natural fiber selected from the group consisting of cotton, wool, hemp or asbestos.

TEST METHODS

Tensile Strength

The bulk tensile strength of the fibers are determined using the method described in ASTM D882-813. The test performed varied from the test as published with respect to the material tested. ASTM D882-81 is for testing thin plastic sheeting and not fibers. The difference is due to the dimensions of the sample. The thickness of the fibers is determined through a snap gauge. Care is taken not to crush the sample with the presser foot of the snap gauge to obtain an accurate thickness. Width of the sample is determined through measurement on an optical microscope.

The samples are tested on a constant rate of grip separation machine to break. Force at maximum load samples is determined.

Volume Resistivity

The volume resistivity of the fibers are determined using the method described in ASTM D257-90, "Standard Test Methods for D-C Resistance or Conductance of Insulating Material".

The following examples are provided for illustrative purposes only and are not limitative.

EXAMPLES

Example 1

A fiber of the present invention was produced in the following manner.

A dry mixture of 85% by weight of a fine powder PTFE resin and 15% by weight of a conductive carbon black (Vulcan XC-72R available from Cabot Corporation, Boston, Mass.) was combined in a blender with an amount of an odorless mineral spirit (Isopar K available from Exxon Corporation) until a compound was obtained. The compound was compressed into a billet and extruded through a 6.4 mm gap die attached to a ram-type extruder to form a coherent extrudate. The coherent extrudate was passed between a pair of calender rolls gapped to reduce the thickness of the coherent extrudate to 4.1 mm.

Subsequently, the odorless mineral spirit was volatilized and removed, and the dry coherent calendered extrudate was expanded uniaxially in the longitudinal direction twice (2×) its original length by passing the dry coherent calendered extrudate over a series of rotating heated rollers. The dry coherent calendered extrudate was slit to 6.4 mm widths by passing the coherent extrudate between a set of gapped blades. The slit coherent extrudate was expanded uniaxially in the longitudinal direction at a ratio of 21.3 to 1 to form the fiber of the instant invention. The inventive fiber was subsequently subjected to an amorphous locking step by exposing the fiber to a temperature in excess of 342° C. for a period of time.

The fiber was subsequently twisted at various amounts about its longitudinal axis to compress the instant fiber. Twisting of the instant fiber was accomplished on a standard fiber twisting machine at room temperature. The physical properties and the effect of twisting on the properties of the fiber of Example 1 are found in Table 1.

TABLE 1

| Sample | Denier (g/9000 m) | Measured Resistance @ 50 cm | Cross Sectional Area (cm2) | Density (g/cc) | Volume Resistance | Bulk Tensile Strength KPa |
|---|---|---|---|---|---|---|
| untwisted | 667 | >300 m ohm | 0.0010 | 0.74 | >6000 ohm cm | 150,000 |
| 4 twists/cm | 670 | 11700 k ohm | 0.00051 | 1.49 | 119 ohm cm | 320,000 |
| 8 twists/cm | 769 | 6890 k ohm | 0.00051 | 1.71 | 70 ohm cm | 360,000 |

Example 2

A fiber of the present invention was produced in the following manner.

A mixture of 75% by weight of a fine powder PTFE resin in an aqueous dispersion and 25% by weight of a conductive carbon black (Ketjenblack 300-J available from Akzo Chemical) was made. First a slurry was made of carbon black in deionized water, and agitated with a rotating impeller. Fine powder PTFE aqueous dispersion (AD-059, ICI Americas Inc.) was added, and the carbon black and PTFE co-coagulated. After drying, the coagulum was combined in a blender with an amount of an odorless mineral spirit forming a compound, the compound was compressed into a billet, and the billet extruded to form a coherent extrudate similar to the steps followed in Example 1.

The coherent extrudate was compressed between calender rolls and the odorless mineral spirit was removed in a method similar to the steps followed in Example 1. The dry coherent calendered extrudate was subsequently expanded at a ratio of 2:1 at a temperature of 270° C.

The dry coherent calendered extrudate had an average thickness of 0.38 mm and a density of 0.374 g/cc. The dry coherent calendered extrudate was slit to 14.7 mm widths by passing the dry coherent calendered extrudate between a set of gapped blades. The slit coherent extrudate was expanded uniaxially in the longitudinal direction at a ratio of 14.35 to 1 and subsequently subjected to an amorphous locking step as in Example 1.

The fiber was subsequently twisted as in Example 1. The physical properties and the effect of twisting on the properties of the fiber of this Example are found in Table 2.

TABLE 2

| Sample | Denier (g/9000 m) | Measured Resistance @ 50 cm | Cross Sectional Area (cm2) | Density (g/cc) | Volume Resistance | Bulk Tensile Strength KPa |
|---|---|---|---|---|---|---|
| 4 twists/cm | 1478 | 198 k ohm | 0.0027 | 0.61 | 10.7 ohm cm | 79,000 |
| 8 twists/cm | 1690 | 85 k ohm | 0.0018 | 1.04 | 3.1 ohm cm | 130,000 |

We claim:

1. A fiber which comprises:

an expanded polytetrafluoroethylene (PTFE) and a conductive particulate filler distributed within the PTFE, the fiber having a bulk tensile strength of at least 65,000 KPa;

wherein the fiber is twisted along its longitudinal axis so as to density the PTFE and decrease its volume resistivity.

2. A fiber as in claim 1 wherein the conductive particulate filler is a metal.

3. A fiber as in claim 1 wherein the conductive particulate filler is a metal oxide.

4. A fiber as in claim 1 wherein the conductive particulate filler as in carbon black.

5. A fiber as in claim 1 wherein the fiber has a volume resistivity of $1\times10^3$ ohm cm or less.

6. A fiber as in claim 1 wherein the fiber has a volume resistivity of 10 ohm or less.

7. A fiber as in claim 1 wherein the fiber has a bulk tensile strength of 200,000 kPa or greater and a volume resistivity of $1\times10^3$ ohm cm or less.

8. A fiber as in claim 1 wherein the fiber has 1 to 18 twists per cm.

9. A fiber as in claim 8 wherein the fiber has 4 to 11 twists per cm.

10. A fiber as in claim 1 wherein the fiber is a continuous monofilament.

11. A fiber as in claim 1 wherein the fiber is a tow.

12. A fiber as in claim 1 wherein the fiber is a stable.

13. A fiber as in claim 1 wherein the fiber is a flock.

* * * * *

UNITED STATES PATENT AND TRADEMARK OFFICE

CERTIFICATE OF CORRECTION

PATENT NO. : 5,262,234

DATED : November 16, 1993

INVENTOR(S) : Raymond B. Minor, et al.

It is certified that error appears in the above-identified patent and that said Letters Patent is hereby corrected as shown below:

Column 5, line 34, "ASTM D882-813" should read "ASTM D882-81"

Signed and Sealed this

Tenth Day of May, 1994

*Attest:*

Bruce Lehman

BRUCE LEHMAN

*Attesting Officer*

*Commissioner of Patents and Trademarks*